US005403182A

United States Patent [19]

Toth et al.

[11] Patent Number: 5,403,182

[45] Date of Patent: Apr. 4, 1995

[54] CONTROL SYSTEM FOR GAS FIRED HEATING APPARATUS USING DOUBLE-THROW RADIANT HEAT SENSING SWITCH

[75] Inventors: Bartholomew L. Toth, Crestwood; William P. Butler, St. Louis, both of Mo.

[73] Assignee: Emerson Electric Co., St. Louis, Mo.

[21] Appl. No.: 254,551

[22] Filed: Jun. 6, 1994

[51] Int. Cl.[6] ..... F23N 5/00

[52] U.S. Cl. ..... 431/66; 431/67

[58] Field of Search ..... 431/66, 67

[56] References Cited

U.S. PATENT DOCUMENTS 5,022,460 6/1991 Brown ..... 165/12

5,169,301 12/1992 Donnelly et al. ..... 431/20

*Primary Examiner*—Carroll B. Dority

*Attorney, Agent, or Firm*—Paul A. Becker, Sr.

[57] ABSTRACT

A control system for a gas fired heating apparatus which apparatus includes a burner, two gas valves and a hot surface igniter, and which control system includes a single-pole, double-throw radiant heat sensing switch having normally-closed contacts which open and normally-open contacts which close in response to the igniter being at a temperature above gas ignition temperature. The normally-closed contacts are connected in series with the electrical winding of one of the gas valves to enable initial opening thereof; circuit means is provided to maintain the valve open when the normally-closed contacts are opened. The normally-open contacts are connected in series with the electrical winding of the other gas valve to enable opening thereof.

3 Claims, 9 Drawing Sheets

POWER SUPPLY
CHARGE PUMP
DRIVER
DRIVER
DRIVER
DRIVER
MICROCOMPUTER
M1
24V
5V
K1A
K2A
K2B
K3A
K1
K2
K3
K4
K4A
K5
K5A
C1
CR1
CR2
CR3
CR4
CR5
R1
T1
R
Y
G
W

POWER-UP
300
CLEAR TRY COUNTER
302
CALL HEAT CIRC DELAY
308
CALL FOR HEAT ?
304
NO
TURN OFF GAS VALVE, IGNITER AND INDUCER
306
YES
314
START
STOP
312
CALL INPUTS CHECK
310
CALL HEAT CIRC DELAY
316
CLEAR 90 SEC SENSING SWITCH TIMER
318
TURN OFF INDUCER
320
IS PRESSURE SWITCH OPEN ?
322
NO
YES

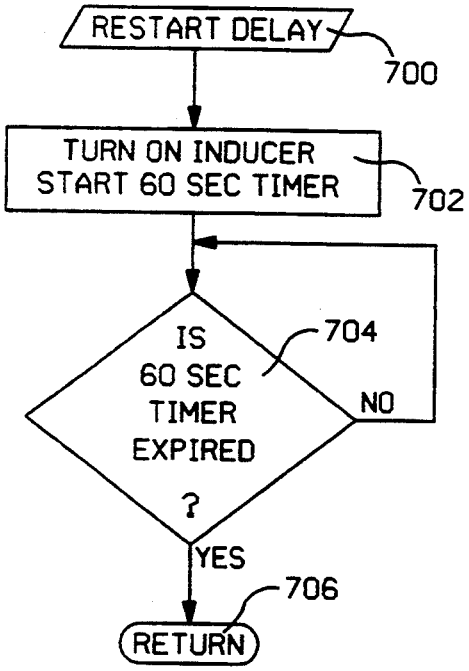
FIG. 5
FIG. 6
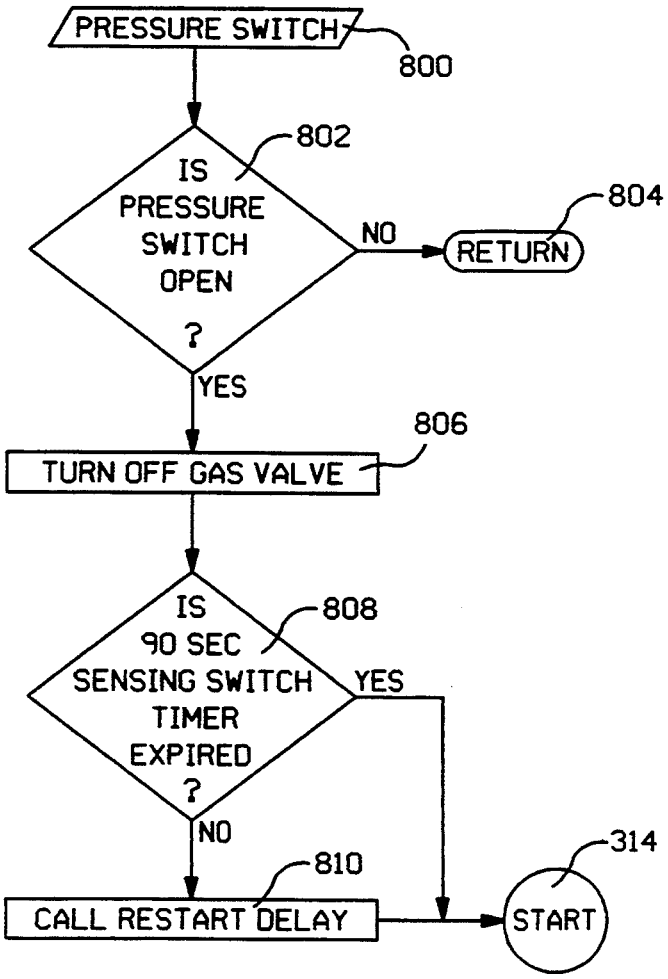

CONTROL SYSTEM FOR GAS FIRED HEATING APPARATUS USING DOUBLE-THROW RADIANT HEAT SENSING SWITCH

BACKGROUND OF THE INVENTION

This invention relates to electrically operated control systems for controlling operation of gas fired heating apparatus which apparatus includes a main burner ignited by a hot surface igniter and which control system includes a radiant heat sensing switch.

U.S. Pat. No. 5,169,301, assigned to the assignee of the present invention, discloses a control system for a gas fired heating apparatus which apparatus includes a main burner, two gas valves connected fluidically in series with the main burner and each gas valve having a controlling electrical winding, and a hot surface igniter for directly igniting gas at the main burner, and which control system includes a radiant heat sensing switch responsive to the igniter and burner flame for controlling the energizing of the igniter and the electrical windings of the gas valves. The radiant heat sensing switch therein has a single set of contacts, normally-closed, which open in response to the igniter being at a temperature above gas ignition temperature and are maintained open thereafter in response to burner flame. The radiant heat sensing switch therein, when its contacts are closed, provides an energizing circuit through its contacts to a relay coil which controls a set of normally-closed contacts and a set of normally-open contacts. When the relay is energized, its normally-open contacts close, enabling energizing of the electrical winding of one of the gas valves, and its normally-closed contacts open, preventing energizing of the electrical winding of the other gas valve. When the radiant heat sensing switch contacts open, the relay is de-energized. With the relay de-energized, the electrical winding of the one gas valve is maintained energized through a circuit in parallel with the relay's normally-open contacts, and the electrical winding of the other gas valve is energized through the relay's normally-closed contacts.

SUMMARY OF THE INVENTION

An object of this invention is to provide a generally new and improved control system for controlling operation of gas fired, direct ignition heating apparatus which control system includes a double-throw radiant heat sensing switch.

A further object is to provide such a system utilizing a microcomputer and related circuitry.

In accordance with the present invention, there is provided a control system for a gas fired heating apparatus which apparatus includes a main burner, two gas valves connected fluidically in series with the main burner and each gas valve having a controlling electrical winding, and a hot surface igniter for directly igniting gas at the main burner, and which control system includes a radiant heat sensing switch responsive to the igniter and burner flame for controlling the energizing of the electrical windings of the gas valves. The radiant heat sensing switch therein comprises a single-pole, double-throw switch having normally-closed contacts which open and normally-open contacts which close in response to the igniter being at a temperature above gas ignition temperature, the normally-open contacts being maintained closed thereafter in response to the burner flame. The radiant heat sensing switch, when its normally-closed contacts are closed, is connected in series with the electrical winding of one of the gas valves to enable energizing of the electrical winding of the one gas valve, and when its normally-open contacts are closed, is connected in series with the electrical winding of the other gas valve to enable energizing of the electrical winding of the other gas valve. The control system includes circuit means for maintaining energizing of the electrical winding of the one gas valve when the normally-closed contacts are open.

The control system further includes a microcomputer and related circuitry, the microcomputer being programmed to provide safe and reliable system operation.

The above-mentioned and other objects and features of the present invention will become apparent from the following description when read in conjunction with the accompanying drawings.

BRIEF DESCRIPTION OF THE DRAWINGS

FIG. 5 is a flow chart depicting the "RESTART DELAY" logic utilized in FIGS. 2A through 2D;

FIG. 6 is a flow chart depicting the "PRESSURE SWITCH" logic utilized in FIGS. 2A through 2D.

DESCRIPTION OF THE PREFERRED EMBODIMENT

Figure 1:
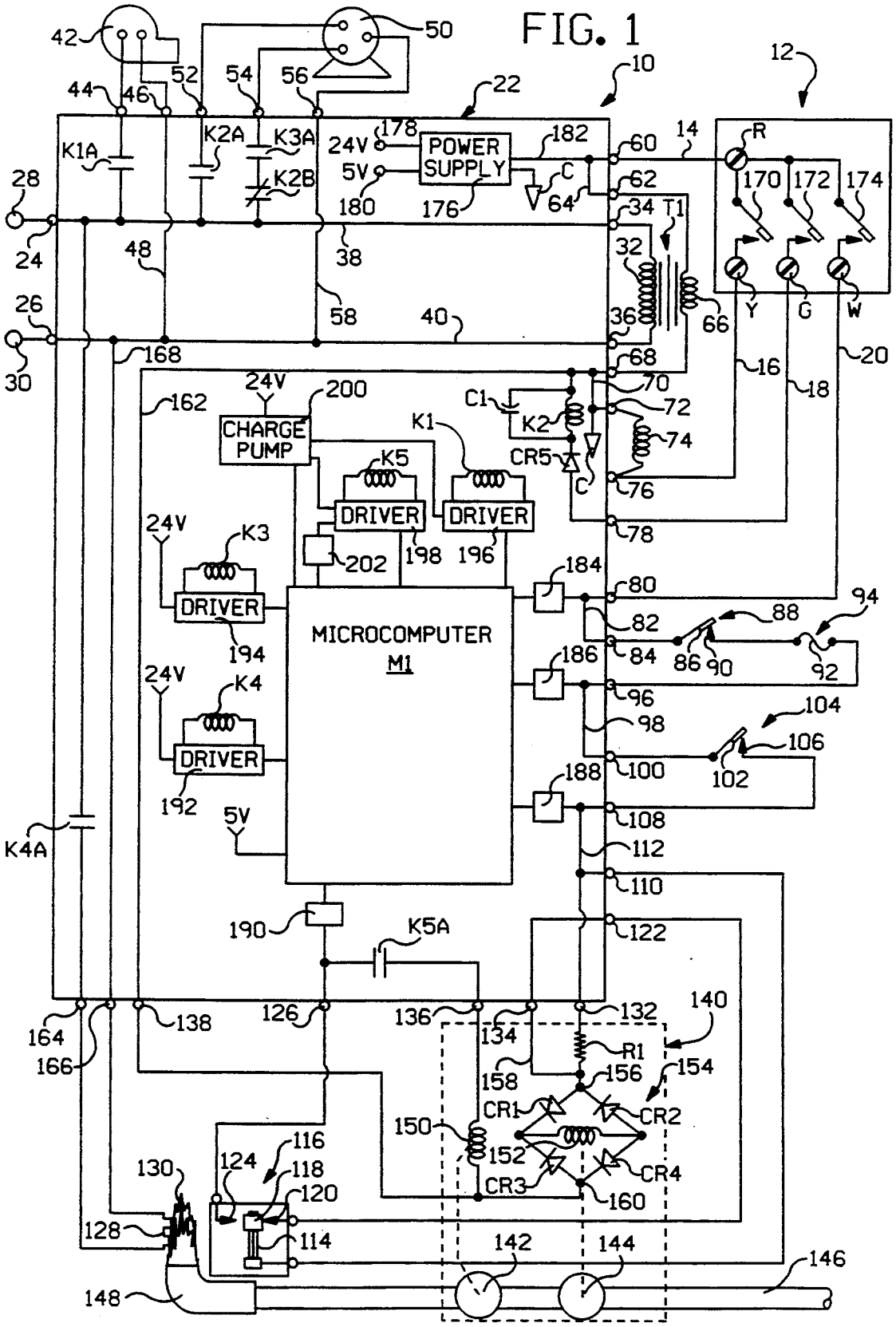
FIG. 1 is a schematic illustration of a control system constructed in accordance with the present invention.

Referring to FIG. 1, shown generally at 10 is a heating and cooling apparatus and control system therefor, and shown generally at 12 is a room thermostat. Apparatus and control system 10 is connected to thermostat 12 by leads 14, 16, 18 and 20. Apparatus and control system 10 includes a control module 22 having a plurality of terminals to which leads 14, 16, 18 and 20 and various apparatus and control system components are connected.

Control module 22 is connected at terminals 24 and 26 to terminals 28 and 30 of a conventional 120 volt alternating current power source. The primary winding 32 of a voltage step-down transformer T1 is connected to control module 22 at terminals 34 and 36. Terminal 34 is connected to terminal 24 by a lead 38, and terminal 36 is connected to terminal 26 by a lead 40.

An inducer 42, sometimes also referred to as a purge fan or combustion air blower, is connected to terminals 44 and 46 of control module 22. Terminal 44 is connected to lead 38 through a set of normally-open relay contacts K1A. Relay contacts K1A are controlled by relay coil K1. Terminal 46 is connected by a lead 48 to lead 40. Inducer 42 is in fluid-flow communication with the combustion chamber of a furnace (not shown). When gas is flowing into the combustion chamber, inducer 42 draws into the combustion chamber the air required for producing a combustible air-gas mixture, and provides a positive means for extracting the products of combustion and any unburned air-gas mixture out of the combustion chamber through the flue.

A circulator fan 50, sometimes referred to as a blower, is connected to terminals 52, 54 and 56 of control module 22. Terminal 52 is connected to lead 38 through a set of normally-open relay contacts K2A. Terminal 54 is connected to lead 38 through a series connection of a set of normally-open relay contacts K3A and a set of normally-closed relay contacts K2B. Relay contacts K2A and K2B are controlled by a relay coil K2; relay contacts K3A are controlled by a relay coil K3. Terminal 56 is connected by a lead 58 to lead 40. Fan 50 provides for the circulation or distribution of conditioned air throughout the dwelling. Fan 50 is a two-speed fan. When relay contacts K2A are closed, fan 50 runs at a relatively high speed; when relay contacts K2B and K3A are closed, fan 50 runs at a relatively low speed.

Lead 14 from a terminal R of thermostat 12 is connected to a terminal 60 of control module 22. A terminal 62 of control module 22 is internally connected by a lead 64 to terminal 60 and externally connected to one side of the secondary winding 66 of transformer T1. The other side of secondary winding 66 is connected to a terminal 68 of control module 22. Terminal 68 is internally connected by a lead 70 to a terminal 72. Lead 70 is also connected to chassis common C, hereinafter referred to as common C.

A compressor contactor coil 74, for effecting energizing of a compressor (not shown) in the cooling apparatus, is connected between terminal 72 and a terminal 76 of control module 22. Lead 16 is connected between terminal 76 and a terminal Y of thermostat 12. A terminal 78 of control module 22 is connected to a terminal G of thermostat 12 by lead 18. A terminal 80 of control module 22 is connected to a terminal W of thermostat 22 by lead 20.

Terminal 80 of control module 22 is internally connected by a lead 82 to a terminal 84. Terminal 84 is externally connected to the movable contact 86 of a normally-closed high limit switch 88. The fixed contact 90 of switch 88 is connected to one side of a thermally-responsive element 92 in a rollout switch 94. The other side of element 92 is connected to a terminal 96 of control module 22. Rollout switch 94 is located in the vestibule portion of the furnace (not shown), and is effective to open its element 92 if it is impinged by flame. High limit switch 88 includes a temperature sensing element (not shown) located in the plenum of the furnace, and is effective to open its contacts 86 and 90 if the temperature in the plenum reaches a value beyond which the furnace is designed to operate safely.

Terminal 96 of control module 22 is internally connected by a lead 98 to a a terminal 100. Terminal 100 is externally connected to the movable contact 102 of a pressure switch 104. The fixed contact 106 of pressure switch 104 is connected to a terminal 108 of module 22. Pressure switch 104 includes a pressure sensitive element (not shown) so located in the furnace as to be responsive to fluid flow effected by inducer 42. Specifically, when inducer 42 is running, the resultant fluid flow causes movement of the pressure sensitive element which, in turn, causes contacts 102 and 106 to close; when inducer 42 is not running, or when the rate of fluid flow is below a predetermined rate, contacts 102 and 106 are open.

A terminal 110 of control module 22 is internally connected by a lead 112 to terminal 108 and externally connected to a bimetallic movable arm 114 of a single-pole, double-throw radiant heat sensing switch 116. Movable arm 114 carries a contact 118. A first fixed contact 120 of switch 116 is connected to a terminal 122 of control module 22. A second fixed contact 124 of switch 116 is connected to a terminal 126 of control module 22. Hereinafter, the set of contacts 118 and 120 are sometimes referred to as the normally-closed contacts, and the set of contacts 118 and 124 are sometimes referred to as the normally-open contacts.

Switch 116 is responsive to radiant heat emitted by a hot surface igniter 128 and by a burner flame 130. Basically, when igniter 128 is sufficiently heated to ignite gas, the radiant heat emitted by igniter 128 causes the bimetallic arm 114 of switch 116 to move such that normally-closed contacts 118 and 120 open and normally-open contacts 118 and 124 close. When flame 130 exists, igniter 128 is impinged by flame 130, causing igniter 128 to glow even though, as will hereinafter be described, it is de-energized when flame 130 exists. The resultant radiant heat emitted by igniter 128 and flame 130 causes movable arm 114 to remain in the position wherein contacts 118 and 124 are closed, sometimes referred to as the hot position. When igniter 128 is not sufficiently heated, or when flame 130 is absent for a sufficiently long time period, movable arm 114 is in the position wherein contacts 118 and 120 are closed, sometimes referred to as the cold position.

Terminals 132, 134, 136 and 138 of control module 22 are connected to a gas valve indicated generally at 140. Gas valve 140 includes two normally-closed valves 142 and 144 connected fluidically in series in a gas conduit 146 leading from a gas source (not shown) to a burner 148. A valve winding 150 controls valve 142, and a valve winding 152 controls valve 144. Both valves 142 and 144 must be open to enable gas to flow to burner 148 so as to establish burner flame 130.

Valve winding 150 is connected at one end to terminal 138 of control module 22 and at its other end to terminal 136. Terminal 136 is internally connected to terminal 126 through a set of normally-open contacts K5A which are controlled by a relay coil K5. Valve winding 152 is connected in a full-wave bridge circuit 154 comprising controlled rectifiers CR1–CR4. A junction 156 of bridge circuit 154 is connected through a resistor R1 to terminal 132 of control module 22. Junction 156 is also connected by a lead 158 to terminal 134 of control module 22. A junction 160 of bridge circuit 154 is connected to terminal 138 of control module 22. Terminal 138 is internally connected by a lead 162 and lead 70 to terminal 68.

One end of igniter 128 is connected to a terminal 164 of control module 22. The other end of igniter 128 is connected to a terminal 166. Terminal 164 is connected to lead 38 through a set of normally-open relay contacts K4A which are controlled by a relay coil K4. Terminal 166 is connected by a lead 168 to lead 40.

Thermostat 12 is illustrated as comprising switches 170, 172 and 174 connected between terminal R and terminals Y, G and W, respectively. It is to be understood that thermostat 12 can take many forms, and that switches 170, 172 and 174 can be mechanical or electronic. Switch 170 controls cooling, switch 172 controls high speed operation of fan 50, and switch 174 controls heating. More specifically, when switch 170 is closed, compressor contactor coil 74 is energized, whereby the compressor in the cooling apparatus is energized. When switch 172 is closed, relay coil K2, which is connected to terminal 78 through a controlled rectifier CR5, is energized, whereby its contacts K2A are closed so as to cause fan 50 to run at its high speed. A filter capacitor C1 is connected across relay coil K2. The manner in which the closing of switch 174 controls heating will be hereinafter described.

Control module 22 incorporates a power supply 176 which provides a 24 volt unidirectional power source at a terminal 178 and a 5 volt unidirectional power source at a terminal 180. Power supply 176 receives its power input from secondary winding 66 of transformer T1 through lead 64 and a lead 182. Power supply 176 is also connected to common C.

Control module 22 further includes a microcomputer M1 and related circuitry for controlling the system components connected thereto. Preferably, microcomputer M1 is an MC68HC05J1 made by Motorola.

More specifically, connected between an input pin of microcomputer M1 and terminal 80 is a buffer 184. Buffer 184 functions to provide specific signals to microcomputer M1 to indicate the status of switch 174 in thermostat 12. For example, when there is no call for heat, switch 174 is open, and in response thereto, buffer 184 provides a digital low signal to microcomputer M1; when there is a call for heat, switch 174 is closed, and in response thereto, buffer 184 provides a 60 Hz signal to microcomputer MI. Similarly, a buffer 186 is connected between an input pin of microcomputer M1 and terminal 96, and functions to indicate the status of limit switch 88 and rollout switch 94. Similarly, a buffer 188 is connected between an input pin of microcomputer M1 and terminal 108, and functions to indicate the status of pressure switch 104. Similarly, a buffer 190 is connected between an input pin of microcomputer M1 and terminal 126, and functions to indicate the status of the normally-open contacts 118 and 124 of radiant heat sensing switch 116.

Connected to selective output pins of microcomputer M1 and to the 24 volt power source provided by power supply 176 at terminal 178 are a plurality of drivers 192, 194, 196 and 198. Driver 192 controls relay coil K4; driver 194 controls relay coil K3; driver 196 controls relay coil K1; and driver 198 controls relay coil K5 . Drivers 196 and 198 are connected to the 24 volt power source through a charge pump 200 which is connected to an output pin of microcomputer M1. A buffer 202 is connected between an input pin of microcomputer M1 and driver 198. Buffer 202 functions to monitor charge pump 200 and the 24 volt power source.

The 5 volt power source provided by power supply 176 at terminal 180 is connected to an input pin of microcomputer M1. There are various other circuits, such as an interrupt circuit, a reset circuit, an oscillator circuit and diagnostic circuits which are utilized in connection with microcomputer M1 but which are not shown.

OPERATION

Microcomputer M1 is programmed to provide system operation in a manner hereinafter described.

Referring to FIG. 1, when electrical power is applied to terminals 24 and 26, transformer T1 is energized. Power supply 176 is then energized to provide the 24 volt and 5 volt power sources at terminals 178 and 180, respectively, which power sources are applied to microcomputer M1.

Figure 2A:
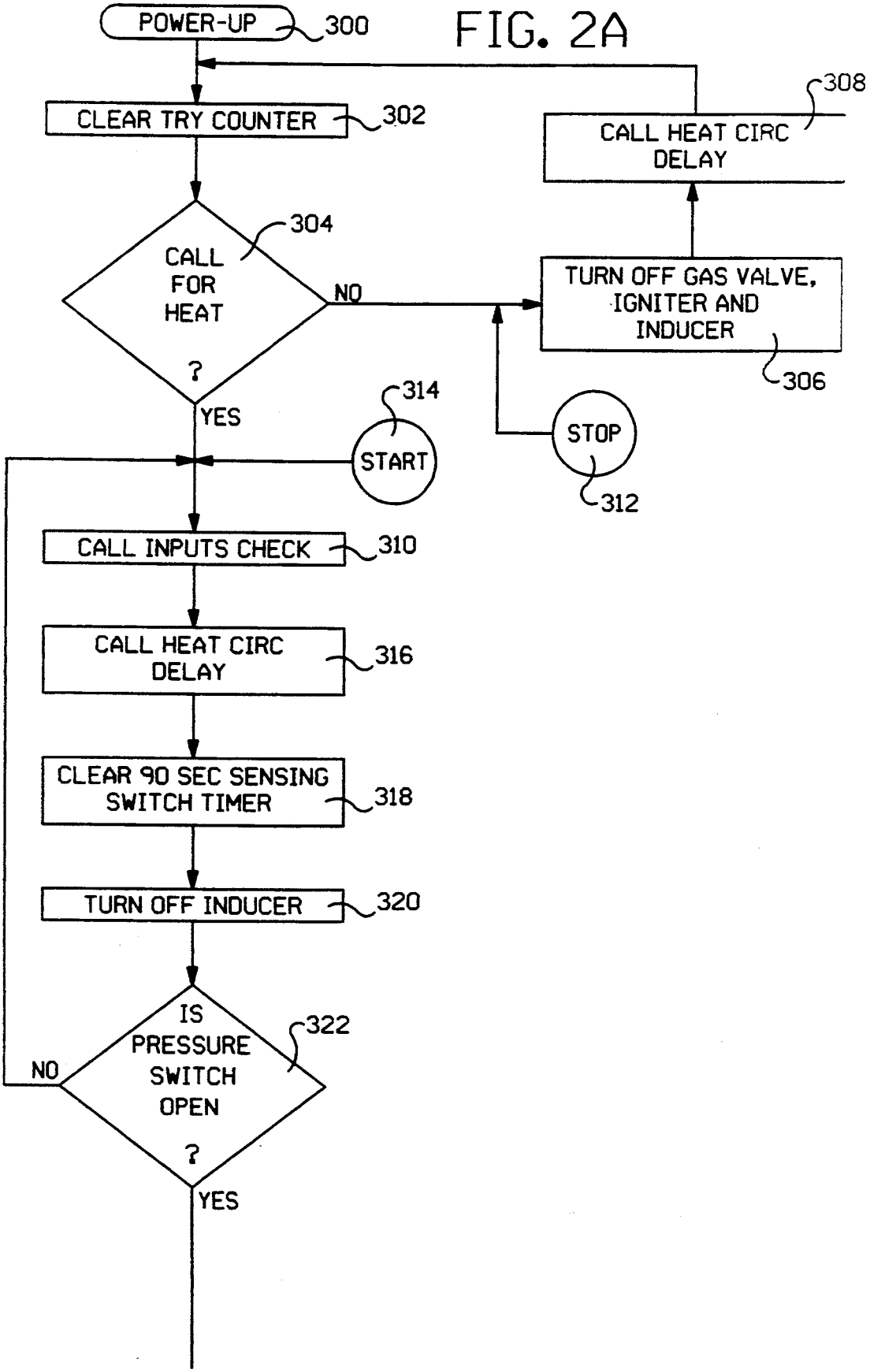
FIGS. 2A through 2D, when combined, is a flow chart depicting the logic sequence programmed into and executed by the microcomputer utilized in the system of FIG. 1.

Referring to FIG. 2A, when the 5 volt power source is applied initially to microcomputer M1, microcomputer M1 powers up at logic step 300. An internal counter, referred to as a "try" counter, is then cleared at logic step 302.

The logic proceeds to an inquiry 304 as to whether there is a call for heat. Whether there is a call for heat is indicated by switch 174 of thermostat 12 through buffer 184. If there is no call for heat, the logic at step 306 provides for turning off gas valve 142, igniter 128 and inducer 42. Specifically, at step 306, microcomputer M1 provides a signal to driver 198 to effect de-energizing of relay coil K5 whereby contacts K5A open to de-energize valve winding 150 and thus cause valve 142 to close. Also, microcomputer M1 provides a signal to driver 192 to effect de-energizing of relay coil K4 whereby contacts K4A open to de-energize igniter 128, and to driver 196 to effect de-energizing of relay coil K1 whereby contacts K1A open to de-energize inducer 42.

Figure 7:
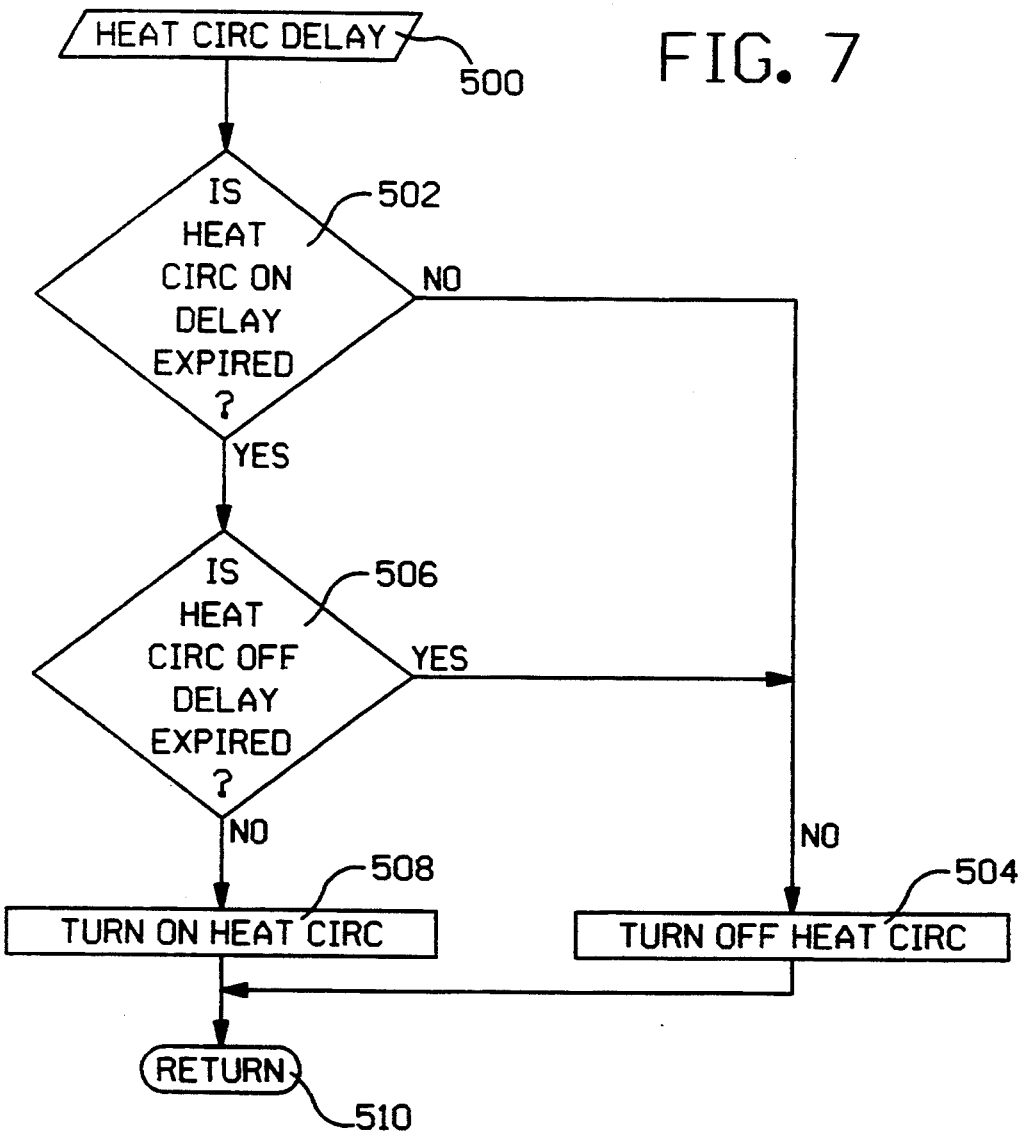
FIG. 7 is a flow chart depicting the "HEAT CIRC DELAY" logic utilized in FIGS. 2A through 2D.

The next logic step 308 determines whether circulator fan 50 should be on or off. Specifically, a "heat circ delay" program routine, identified as routine 500 in FIG. 7, is called up at step 308. The notation of "heat circulator" refers to fan 50 when operated at low speed. It is noted that microcomputer M1, in conjunction with driver 194, relay coil K3 and its contacts K3A, controls only the heat circulator (fan 50 at low speed); the high speed operation of fan 50 is controlled by relay contacts K2A whose coil K2 is controlled directly by switch 172 in thermostat 12. Unless specifically stated otherwise, description hereinafter of heat circulator being on or off refers to low spped operation of fan 50.

Referring to FIG. 7, the first inquiry 502 is whether the heat circulator on delay is expired. If not, the heat circulator is turned off in logic step 504. If yes, the logic proceeds to an inquiry 506 as to whether the heat circulator off delay is expired. If yes, the heat circulator is turned off in logic step 504; if no, the heat circulator is turned on in logic step 508. The off delay and on delay are internal timers which are set in response to various conditions as hereinafter described. To effect turn on of fan 50, microcomputer M1 provides an enabling signal to driver 194 to effect energizing of relay coil K3 whereby contacts K3A are closed. To effect turn off of fan 50, such enabling signal is not provided. After either logic step 504 or 508, the program returns at 510 to the main program of FIG. 2A. Referring again to FIG. 2A, after step 308, the logic loops back to logic step 302.

Referring to FIG. 2A, if there is a call for heat at step 304, the logic proceeds to step 310 where an "inputs check" program routine is called up. The "inputs check" routine, identified as routine 600 in FIG. 4, begins with a logic inquiry 602 as to whether there is a call for heat. If no, the program stops at 312. As shown in FIG. 2A, stop 312 enters the program logic at step 306.

Figure 4:
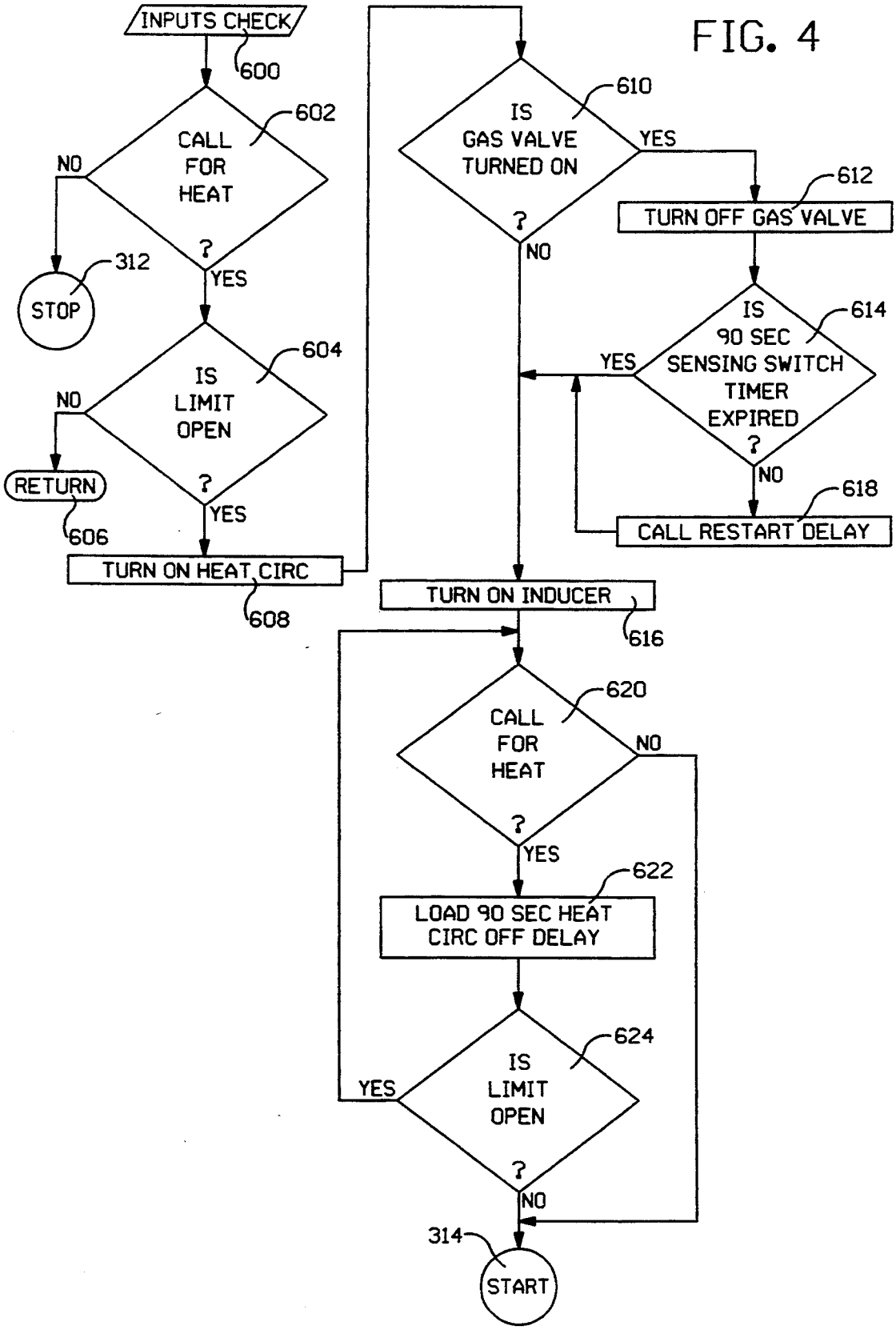
FIG. 4 is a flow chart depicting the "INPUTS CHECK" logic utilized in FIGS. 2A through 2D.

If there is a call for heat at logic step 602, the logic of FIG. 4 proceeds to an inquiry 604 as to whether the limit is open. Whether the limit is open is indicated by buffer 186 in FIG. 1. It is noted that the "limit" referred to here comprises either the high limit switch 88 or the rollout switch 94. If neither "limit" switch 88 nor 94 is open, the program returns at 606 to the main program of FIG. 2A.

If either "limit" switch 88 or 94 is open, the program logic in FIG. 4 provides for turning on the heat circulator at step 608. The logic then proceeds to an inquiry 610 as to whether the gas valve is turned on. When microcomputer M1 requests that the gas valve (valve 142) be turned on, it provides enabling signals to charge pump 200 and driver 198 to effect energizing of relay coil K5, whose contacts K5A control energizing of winding 150 of gas valve 142. Such enabling signals cause buffer 202 to provide a specific signal to microcomputer Mi. Thus, the logic inquiry 610 as to whether the gas valve is turned on is effected by checking buffer 202. It is to be noted that microcomputer M1 controls only gas valve 142; it does not control gas valve 144. Gas valve 144 is controlled by sensing switch 116.

If the gas valve (valve 142) is turned on, the logic proceeds from inquiry 610 to step 612 wherein the gas valve 142 is turned off. The next inquiry 614 is whether a 90 second sensing switch timer has expired. If yes, inducer 42 is turned on at step 616. If no, a "restart delay" program routine is called up at logic step 618. As will be hereinafter described in more detail, this 90 second timer is an internal timer which is started shortly after contacts 118 and 124 in sensing switch 116 make. Therefore, if the 90 second timer has expired, contacts 118 and 124 have been in the closed-contact position for at least 90 seconds.

The "restart delay" program routine, identified as routine 700 in FIG. 5, begins with execution step 702 wherein inducer 42 is turned on and an internal 60 second timer is started. Microcomputer M1 effects turn on of inducer 42 by providing an enabling signal to driver 196 to effect energizing of relay coil K1 whereby contacts K1A are closed. In accordance with the next logic inquiry 704, after 60 seconds, the routine returns at 706 to the routine of FIG. 4. As illustrated in FIG. 4, after execution of step 618, the logic proceeds to the execution step 616 of turning on inducer 42.

Referring to FIG. 4, after step 616, the logic proceeds to an inquiry 620 as to whether there is a call for heat. If yes, the heat circulator off delay timer is loaded for 90 seconds at step 622. The next logic step is an inquiry 624 as to whether the limit is open. If yes, the program loops back to inquiry 620. If there is no call for heat at inquiry 620 or if the limit is not open at inquiry 624, the program goes to start at 314. As shown in FIG. 2A, start 314 enters the program logic at execution step 310.

Referring again to FIG. 2A, after step 310, the next logic step 316 is to call the heat circulator delay routine. Then the 90 second sensing switch timer is cleared at step 318 and inducer 42 is turned off at step 320. The next logic step is an inquiry 322 as to whether the pressure switch is open. Whether the pressure switch is open is indicated by pressure switch 104 through buffer 188. If pressure switch 104 is not open, the logic loops back to step 310; if pressure switch 104 is open, as it should be since inducer 42 is turned off, the logic proceeds to effect turning on inducer 42 in logic step 324 of FIG. 2B.

After inducer 42 is turned on at step 324, the inputs check routine is called at step 326. Then the heat circulator delay routine is called at step 328. The next logic step is inquiry 330 as to whether the pressure switch 104 is closed. If not, the logic loops back to step 324; if yes, as it should be since inducer 42 is turned on, the logic proceeds to step 332.

In logic step 332, igniter 128 is turned on. This is effected by providing an enabling signal to driver 192 to effect energizing of relay coil K4 whose contacts K4A control energizing of igniter 128. Also, in logic step 332, microcomputer M1 starts two internal timers, designated as ignition timers; one timer is set for 17 seconds and the other timer is set for 90 seconds.

The next logic step is inquiry 334 as to whether the 17 second ignition timer has expired. If no, the logic proceeds to step 336 wherein the inputs check routine and the heat circulator delay routine are called. Also called up is a "pressure switch" program routine identified as program routine 800 in FIG. 6. Referring to FIG. 6, the first inquiry 802 is whether pressure switch 104 is open. If pressure switch 104 is closed, as it should be since inducer 42 is turned on, the logic returns at 804 to the main program of FIG. 2B. If pressure switch 104 is open, microcomputer M1 provides for turning off gas valve 142 at logic step 806. The next logic step is inquiry 808 as to whether the 90 second sensing switch timer has expired. If no, the restart delay routine is called up at 810; if yes, the logic proceeds to start at 314. After executing the restart delay routine 700, the logic proceeds to start 314.

If the 17 second ignition timer has expired in step 334, the logic proceeds to inquiry 338 as to whether the sensing switch 116 is in the hot position. Whether the switch 116 is in the hot position, wherein its contacts 118 and 124 are closed, is indicated to microcomputer M1 through buffer 190.

If the answer to inquiry 338 is no, the logic proceeds to logic step 340 and then inquiry 342. Logic steps 340 and 342 allow a total of 90 seconds, from the start of energizing of igniter 128, for switch 116 to close its contacts 118 and 124. Typically, it requires approximately 15 seconds for igniter 128 to effect closing of contacts 118 and 124 in switch 116. If the 90 second ignition timer expires, the logic proceeds to an "auto reset" program routine at step 344.

Figure 3:
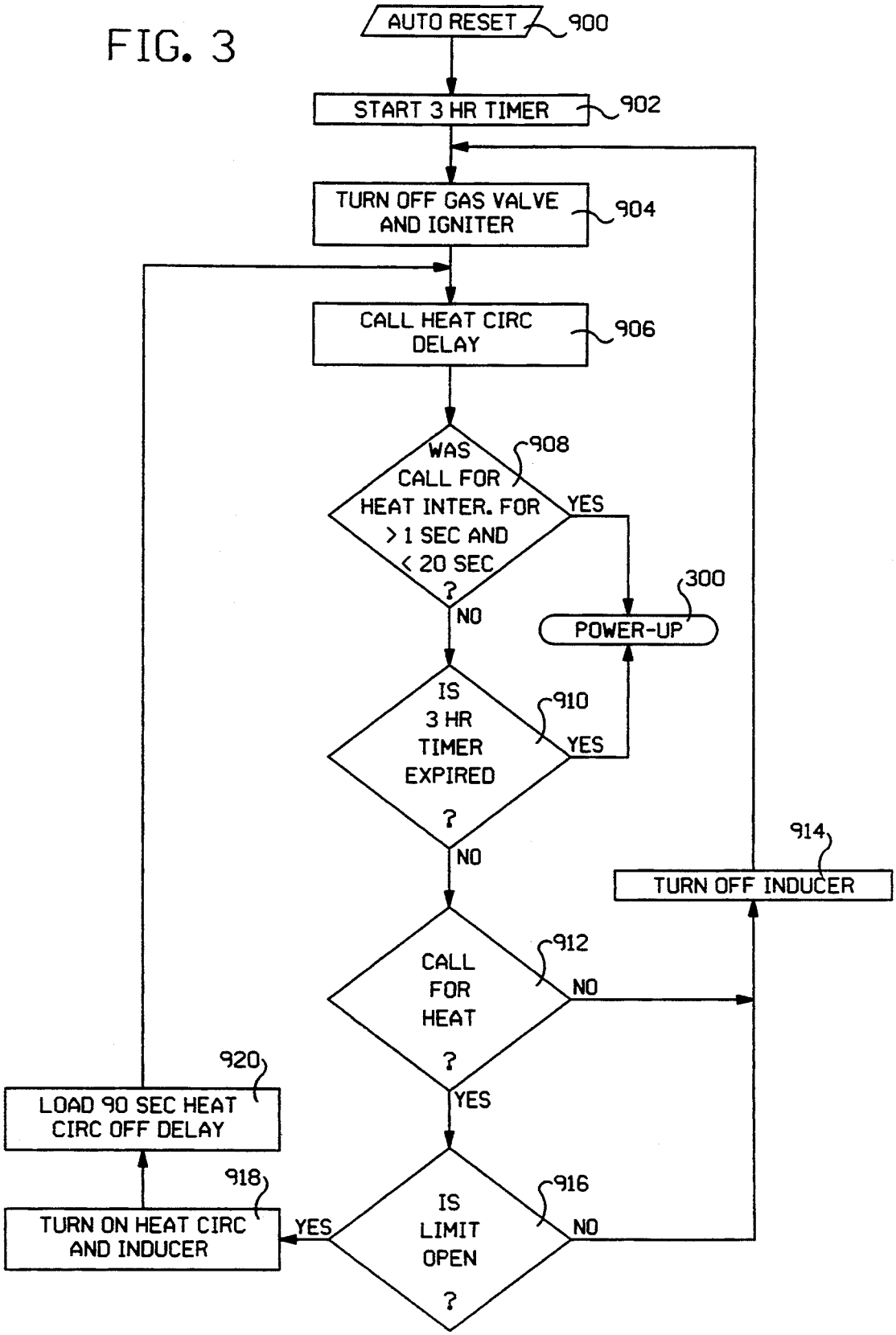
FIG. 3 is a flow chart depicting the "AUTO RESET" logic utilized in FIGS. 2A through 2D.

Referring to FIG. 3, the "auto reset" program routine is identified as program routine 900. The first logic step therein is to start an internal 3 hour timer at step 902. Then the gas valve 142 and igniter 128 are turned off at step 904. The heat circulator delay routine is called up at step 906. The next logic step is an inquiry 908 as to whether the call for heat was interrupted for greater than 1 second and less then 20 seconds. If yes, the program proceeds to power-up 300. If no, the logic proceeds to an inquiry 910 as to whether the 3 hour timer has expired. If yes, the program proceeds to power-up 300. Thus, power-up 300 can be attained after 3 hours or if the call for heat is interrupted within a predetermined time parameter. Greater than 1 second and less than 20 seconds permits attaining power-up 300 by manual off-on actuation of thermostat 12, but prevents attaining power-up 300 due to, for example, de-bounce or cycling of thermostat 12 due to timed anticipation. If the power source to module 22 is turned off and then on again, the system will also go to power-up 300.

If the 3 hour timer has not expired in logic step 910, the logic proceeds to inquiry 912 as to whether there is a call for heat. If no, inducer 42 is turned off at logic step 914 and the program loops back to logic step 904. If yes, the logic proceeds to inquiry 916 as to whether the limit is open. If no, the logic proceeds to step 914. If yes, the heat circulator and inducer 42 are turned on at logic step 918. Then the heat circulator off delay timer is loaded for 90 seconds at step 920 and the program loops back to logic step 906.

Figure 2B:
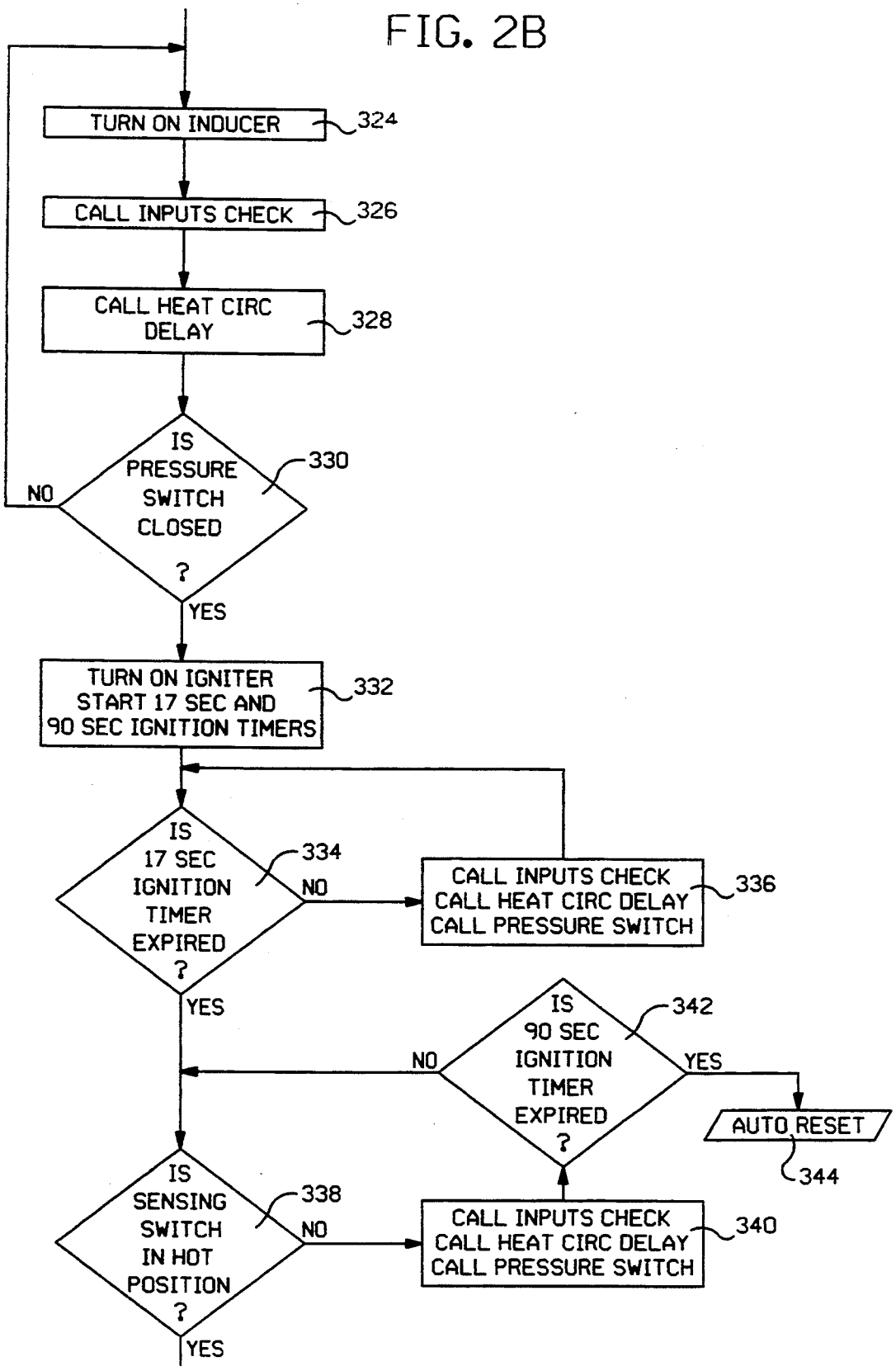
Figure 2C:
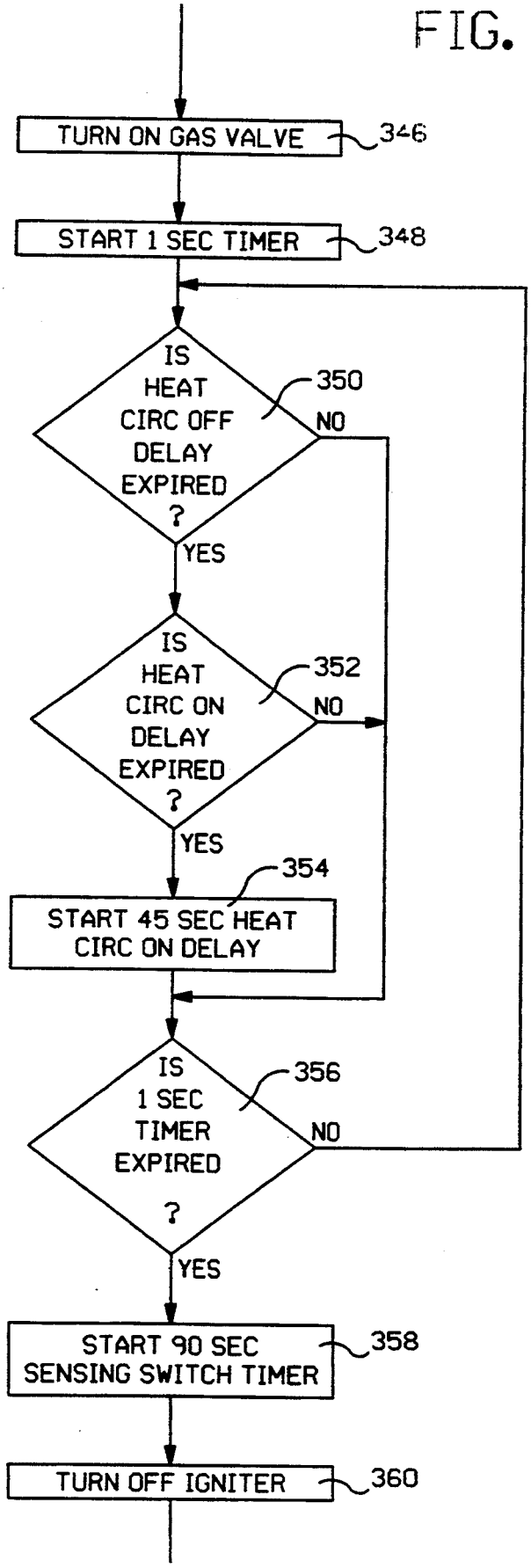

If the answer to inquiry 338 of FIG. 2B is yes, the logic proceeds to step 346 in FIG. 2C wherein gas valve 142 is turned on.

When sensing switch 116 is in its cold position, wherein its contacts 118 and 120 are closed, valve winding 152, which controls valve 144, is energized through lead 158 so as to cause valve 144 to open. Gas cannot flow to burner 148 until valve 142 is also open. When sensing switch 116 is in its hot position at logic step 338, valve winding 150 is energized through contacts 118 and 124 of switch 116, causing valve 142 to open. Gas then flows to burner 148. When contacts 118 and 120 of switch 116 open, valve winding 152 remains energized through resistor R1 at a level sufficient to hold valve 144 open but insufficient to open it from a closed position.

A 1 second timer is then started at logic step 348. The program logic provides for checking whether the circulator off delay timer and circulator on delay timer have expired at logic steps 350 and 352, respectively, and for starting a 45 second heat circulator on delay timer at logic step 354 if both the off delay and on delay timers have expired. After the 1 second timer has expired at logic step 356, the program logic proceeds to start the 90 second sensing switch timer at step 358 and then igniter 128 is turned off at step 360.

Although igniter 128 is de-energized, its mass is sufficient to enable it to maintain, for a short time period after being de-energized, a temperature sufficiently high to ignite gas. Under normal operating conditions, ignition will occur shortly before or shortly after igniter 128 is turned off at logic step 360. When ignition occurs, burner flame 130 impinges upon igniter 128, causing igniter 128 to emit sufficient radiant heat to sensing switch 116 to keep it in its hot position wherein its contacts 118 and 124 are closed.

Figure 2D:
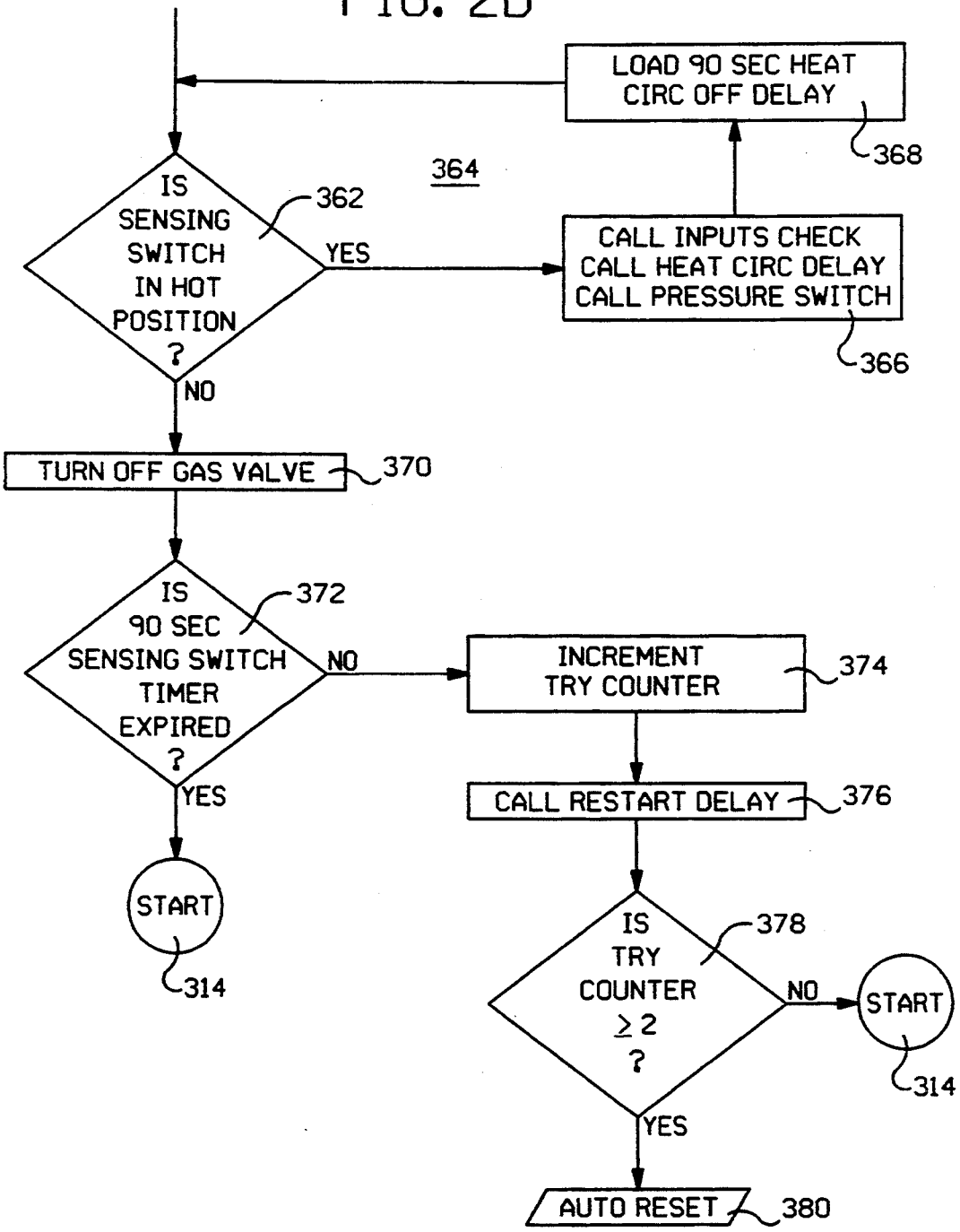

Referring to FIG. 2D, the logic inquiry 362 is whether sensing switch 116 is in its hot position. If yes, the program remains in the operating loop 364 wherein, as long as sensing switch 116 is in its hot position, the program calls up the inputs check program routine 600, the heat circulator delay program routine 500 and the pressure switch program routine 800 at step 366, and the 90 second heat circulator off delay timer is loaded at step 368.

Under normal operating conditions, when the 45 second heat circulator on delay timer started at step 354 of FIG. 2C expires, fan 50 is turned on in accordance with logic steps 502, 506 and 508 of the heat circulator delay program routine 500 of FIG. 7.

Under normal operating conditions, the operating loop 364 is terminated by the opening of thermostat contacts 174. In reference to the inputs check program routine 600 of FIG. 4, the logic proceeds to stop at 312 when the call for heat is terminated. Referring to FIG. 2A, when the program is entered at stop 312, gas valve 142, igniter 128 and inducer 42 are turned off at step 306. Logic step 308, in accordance with the heat circulator delay program routine 500 of FIG. 7, provides for running fan 50 until the 90 second heat circulator off delay timer is expired at logic step 506 therein.

It is noted that operating loop 364 of FIG. 2D can also be terminated by the opening of the limit in step 604 of the inputs check program routine 600 of FIG. 4 or by the opening of pressure switch 104 in step 802 of the pressure switch program routine 800 of FIG. 6. The logic executed by microcomputer M1 as a result of such switch openings proceeds in the manner previously described.

Referring again to FIG. 2D, if sensing switch 116 is no longer in its hot position in logic inquiry 362, gas valve 142 is turned off in logic step 370. The next logic step is inquiry 372 as to whether the 90 second sensing switch timer is expired. The 90 second timer was started at logic step 358, 1 second after switch 116 switched to its hot position. Typically, it requires approximately 45 seconds for switch 116 to leave its hot position if there has been no flame, and approximately 30 seconds if flame existed and is subsequently extinguished. Therefore, if the 90 second sensing switch timer is expired at step 372, which means switch 116 was in its hot position for at least 91 seconds, it is fairly certain that flame 130 existed, at least for a short time period. If the answer to logic inquiry 372 is yes, the logic proceeds to start 314 which, as shown in FIG. 2A, enters the main program at logic step 310.

If the answer to logic inquiry 372 is no, the internal try counter is incremented at logic step 374. The restart delay program routine 700 is then called up at logic step 376. As shown in FIG. 5, the restart delay program routine 700 provides for 60 seconds of operation of inducer 42. Such operation of inducer 42 purges the combustion chamber of any unburned fuel that may have accumulated therein. The logic then proceeds to an inquiry 378 as to whether the count in the try counter is greater than or equal to 2. If no, the logic proceeds to start 314. If yes, the auto reset program routine 900 is called up at logic step 380.

It is noted that if the 90 second sensing switch timer is not expired at logic step 372, it is likely that flame was never established. Since the reason for this malfunction may have been a transitory condition, such as a low voltage condition or low gas pressure, the programmed logic, by means of the try counter, provides for a second attempt at ignition before the logic causes the system to enter auto reset. As previously described, in accordance with the auto reset program routine 900 of FIG. 3, the system will automatically power up after the 3 hour timer has expired, when thermostat 122 is manually actuated off and on, or when the power source to module 22 is turned off and then on again.

While the invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

We claim:

1. In a control system for a gas fired heating apparatus which apparatus includes a main burner, two gas valves connected fluidically in series with said main burner and each of said gas valves having a controlling electrical winding, and a hot surface igniter for directly igniting gas at said main burner, and which control system includes a radiant heat sensing switch responsive to said igniter and burner flame for controlling energizing of said electrical windings of said gas valves, the improvement wherein said radiant heat sensing switch comprises a single-pole, double-throw switch having normally-closed contacts which open and normally-open contacts which close in response to said igniter being at a temperature above gas ignition temperature, said normally-open contacts being maintained closed thereafter in response to said burner flame, said normally-closed contacts being connected in series with the electrical winding of one of said gas valves to enable initial opening of said one of said gas valves, circuit means for maintaining energizing of said electrical winding of said one of said gas valves when said normally-closed contacts are opened so as to maintain said one of said gas valves open after it is initially opened, and said normally-open contacts being connected in series with the electrical winding of the other one of said gas valves to enable opening of said other one of said gas valves.

2. In a control system for a gas fired heating apparatus which apparatus includes a main burner, two gas valves connected fluidically in series with said main burner and each of said gas valves having a controlling electrical winding, a hot surface igniter for directly igniting gas at said main burner, an inducer, and a circulator fan, a single-pole, double-throw radiant heat sensing switch having normally-closed contacts which open and normally-open contacts which close in response to said igniter being at a temperature above gas ignition temperature, said normally-open contacts being maintained closed thereafter in response to burner flame;

first circuit means including a series connection of said normally-closed contacts of said radiant heat sensing switch and the electrical winding of one of said gas valves for enabling initial opening of said one of said gas valves;

second circuit means including a series connection of a resistor and said electrical winding of said one of said gas valves for maintaining energizing of said electrical winding of said one of said gas valves when said normally-closed contacts of said radiant heat sensing switch are opened so as to maintain said one of said gas valves open after it is initially opened;

third circuit means including a series connection of said normally-open contacts of said radiant heat sensing switch, the electrical winding of the other one of said gas valves, and a set of normally-open relay contacts for enabling opening of said other one of said gas valves; and a microcomputer and related circuitry, including a relay coil and a driver circuit therefor, for controlling said normally-open relay contacts.

3. The control system claimed in claim 2 wherein said related circuitry further includes a plurality of relay coils and driver circuits therefor for controlling, through associated relay contacts and in conjunction with said microcomputer, operation of said igniter, inducer and circulator fan.

* * * * *